US008695776B2

(12) United States Patent
Cha et al.

(10) Patent No.: US 8,695,776 B2
(45) Date of Patent: Apr. 15, 2014

(54) BUNDLE BILL/CHECK ACCEPTOR

(75) Inventors: Jin Hwan Cha, Seoul (KR); Kyung Joo Shin, Seoul (KR); Woo Ho Lee, Seoul (KR); Ho Keun Lee, Seoul (KR); Hyun Soo Jang, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 0 days.

(21) Appl. No.: 13/554,094

(22) Filed: Jul. 20, 2012

(65) Prior Publication Data

US 2013/0020172 A1 Jan. 24, 2013

(30) Foreign Application Priority Data

Jul. 21, 2011 (KR) ..... 10-2011-0072337

(51) Int. Cl.
*G07F 7/04* (2006.01)
*B65H 9/16* (2006.01)

(52) U.S. Cl.
USPC ..... 194/206; 271/252

(58) Field of Classification Search
USPC ..... 194/205, 206, 210; 209/534; 235/379; 271/226, 227, 228, 248, 250, 252
See application file for complete search history.

(56) References Cited

U.S. PATENT DOCUMENTS

| | | | | |
|---|---|---|---|---|
| 6,663,001 | B2 * | 12/2003 | Suttie et al. | 235/379 |
| 2007/0181668 | A1 | 8/2007 | Kwak et al. | |
| 2010/0059586 | A1 | 3/2010 | Lee et al. | |
| 2010/0283199 | A1 | 11/2010 | Yasumoto | |

FOREIGN PATENT DOCUMENTS

| | | |
|---|---|---|
| EP | 0317537 | 5/1989 |
| EP | 1331185 | 7/2003 |
| KR | 10-2010-0030085 | 3/2010 |

OTHER PUBLICATIONS

European Search Report dated Nov. 9, 2012 for European Patent Application No. EP 12177244.6, 5 pages.

* cited by examiner

*Primary Examiner* — Mark Beauchaine
(74) *Attorney, Agent, or Firm* — Fenwick & West LLP

(57) ABSTRACT

A bundle bill/check acceptor includes a bundle receiving module to receive a bundle of bills/checks. The bundle of bills/checks is separated on a leaf-by-leaf basis by a transfer module. The accepter further includes an alignment module to align the individual bill/check, an escrow module to escrow a plurality of bills/checks, and a reject module to discharge a rejected bill/check or a bill/check escrowed by the escrow module requested to cancel the deposit thereof to the bundle receiving module. A normal bill and check are separately received in a cassette unit.

13 Claims, 6 Drawing Sheets

BUNDLE BILL/CHECK ACCEPTOR

RELATED APPLICATION

This application claims the benefit of Korean Patent Application No. 10-2011-0072337, filed on Jul. 21, 2011, which is hereby incorporated by reference as if fully set forth herein.

FIELD OF THE INVENTION

The present invention relates to a bill and check accepter, and more particularly, to a bundle bill and check acceptor which allows bills and/or checks to deposit in a bundle rather than depositing one after another.

BACKGROUND OF THE INVENTION

Generally, financial automated apparatuses such as CDUs (Cash Dispenser Units) or BRMs (Bill Recycling Machines) have been developed to rapidly and conveniently provide the majority of financial services other than a face-to-face service in an unmanned manner regardless of the time. Such financial automated apparatuses are typically referred to as ATMs (Automated Teller Machine).

ATMS are imparted with functions for providing a variety of financial services as well as a cash deposit/withdrawal function.

In the case of cash, depending on the face value, the sizes and shapes of cash may vary, while cash of the same face value has the same size and shape. Thus, ATMs can accept a predetermined number of bills in a bundle. However, unlike bills, a variety of characters are printed on a check using a specific magnetic ink. A check acceptor reads characters, such as the serial number, printed on a check using a MICR (Magnetic Ink Character Reader) and then processes the deposit of the check.

The check acceptor generally includes an introduction unit which accepts a check, a check alignment unit which aligns the introduced check in a predetermined position, a transfer unit which transfers the aligned check, an MICR unit which reads information on the check, a printing unit that prints a character string transmitted from a top portion of the check onto the rear surface of the check, and a storage unit which sequentially stacks and stores checks that have been subjected to a deposit process.

In the check acceptor configured as above, unlike the automated bill deposit/withdrawal function of the ATM that accepts a bundle of a predetermined number of bills using the input unit, checks should be oriented in a specific direction and introduced into the introduction unit one after another so that the checks can be transferred along a predetermined transfer path and stored in the storage unit. That is, a check must be introduced into the introduction unit in a preset orientation in order for a check transfer operation to be able to be carried out. Moreover, there is a limited number of checks that can be introduced.

Therefore, a lot of checks should be inserted into the check acceptor over several times, causing the check deposit transaction to be time-consuming, and inconveniencing the user.

Furthermore, although all checks may be the same size for a certain country, for example, the size of a personal check personally issued may be different from that of a business check issued by a corporation. The check acceptor cannot process checks of different sizes.

In an effort to overcome the above problems, a bulk check acceptor was proposed in Korean Patent Laid-open Publication No. 10-2010-0030085, which was filed and commonly assigned to the applicant of the present invention. This bulk check acceptor can accept checks in a bundle regardless of the size of the checks or an orientation in which the checks are input into the bulk check acceptor. Further, components are efficiently arranged, thus increasing convenience of use, and achieving a compact design.

However, BNAs (Bundle Note Acceptors) which can accept bills in a bundle and BCAs (Bundle Check Acceptors) which can accept checks in a bundle are separately provided, thus inconveniencing users, and requiring a lot of installation space. Given purchase cost as well as the above disadvantageous factors, a combination of a BNA and a BCA is strongly required.

SUMMARY OF THE INVENTION

In view of the above, therefore, the present invention provides a bundle bill/check acceptor, capable of accepting checks in a bundle regardless of the size or orientation of the checks rather than requiring that checks be introduced one after another in a specific orientation.

Further, the present invention provides a bundle bill/check acceptor capable of accepting a bundle of combined bills and checks that are introduced into the acceptor.

Further, the present invention provides a bundle bill/check acceptor capable of in which components are efficiently arranged, thus achieving a compact design.

Embodiments relate to a bundle bill and check acceptor which allows bills and/or checks to deposit in a bundle rather than depositing one after another.

In embodiments, a bundle bill/check acceptor includes: a bundle receiving module configured to receive a bundle of bills/checks that are introduced into the bundle bill/check acceptor; a transfer module disposed behind the bundle receiving module, wherein the transfer module is configured to separate the bundle of bills/checks received from the bundle receiving module into individual bill/check on a leaf-by-leaf basis, and then transferring the individual bill/check; a bill checker module configured to discriminate authenticity of the individual bill or check that is being transferred and to monitor an image of the individual bill or check; an alignment module configured to align the individual bill/check transferred from the bill checker module; a recognition module disposed right below the alignment module, the recognition module is configured to read data on each of the individual checks transferred from the alignment module; an escrow module disposed on a front end of the acceptor body, the escrow module is configured to escrow the bills/checks transferred from the recognition module; a print module disposed between the recognition module and the escrow module, the print module is configured to endorse each of the checks escrowed by the escrow module; a reject module disposed in a central portion of the acceptor body, the reject module is configured to discharge, to the bundle receiving module, a rejected bill/check that cannot be discriminated by the bill checker module or a bill/check escrowed by the escrow module requested to cancel the deposit thereof; and a cassette unit provided in a lower portion of the acceptor body, wherein the cassette unit is configured to separately receive the bills escrowed by the escrow module, the check endorsed by the print module, a retraction bill/check of the rejected bill/check discharged to the bundle receiving module by the reject module, and a bill/check that is determined as being a counterfeit bill/check by the recognition module.

In embodiments, the alignment module includes: a drum-shaped alignment body defining a transfer path along which each of the bills/checks from the transfer module is passing in circle; a main transfer roller provided in the drum-shaped body; a slant roller provided outside the drum-shaped body, whereby the bill/check is aligned with one side of the transfer path; and an alignment sensor provided on the transfer path configured to sense whether the bill/check is aligned with a reference alignment surface, wherein the aligned bill/check that has been sensed by the alignment sensor is transferred to the recognition module.

In embodiments, the drum-shaped alignment body includes: a fixed body around which the paper medium that is passing moves in circle; and rotatable bodies which are provided on both ends of the fixed body, wherein the diameter of the rotatable bodies is larger than that of the first body, and the side surface of the rotatable bodies that faces the first body becomes the reference alignment surface for the paper medium.

In embodiments, each of the rotatable bodies is configured to rotate with respect to the fixed body.

In embodiments, the alignment module further comprises a slant angle adjustment unit configured to adjust the angles of the slant rollers based on information obtained from the alignment sensor.

In embodiments, the recognition module comprises an MICR (Magnetic Ink Character Reader) reading information on each of the checks transferred thereto before transferring the check to the escrow module.

In embodiments, in response to a request for entire or selective deposit approval of the bills/checks escrowed by the escrow module, the escrow module is configured to separate the escrowed bills/checks one after another and then transfers the separated bill/check to the cassette unit, and wherein the separated check is transferred to the print module before being transferred to the cassette unit.

In embodiments, in response to a request for entire or selective deposit cancel of the bills/checks escrowed by the escrow module, the escrow module is configured to separate the escrowed bills/checks one after another and then transfers the separated bill/check one after another to the bundle receiving module via the reject module.

In embodiments, the bundle bill/check acceptor further includes: a U-shaped transfer path disposed below the recognition module; and first and second 3-way switching gates sequentially provided on a transfer path between the recognition module and the escrow module.

In embodiments, the first 3-way switching gate is selectively switched: such that a rejected bill/check recognized by the bill checker or the recognition module is transferred to the reject module; such that the bill/check escrowed by the escrow module is transferred to the reject module in response to the request for deposit cancel; or such that the bills/checks escrowed by the escrow module is transferred to the cassette unit in response to the request for deposit approval.

In embodiments, the second 3-way switching gate is selectively switched: such that normal bills/checks escrowed by the escrow module are transferred to the cassette unit via the first 3-way switching gate and the U-shaped transfer path; such that the escrowed check is transferred to the print module if an endorsement surface of each of the checks escrowed by the escrow module is oriented in a correct direction; or such that the escrowed check is transferred to the print module after being transferred to the transfer path between the first and second 3-way switching gates if an endorsement surface of each of the checks is not oriented in the correct direction.

In embodiments, the cassette unit includes: a bill storage cassette for receiving normal bills; and a check storage cassette for receiving normal checks, wherein the bill storage cassette and the check storage cassette have a same structure and are disposed level with and adjacent to each other.

In embodiments, the cassette unit further includes: a retraction box separately storing retraction bills/checks of the rejected bills/checks discharged to the bundle receiving module by the reject module, and counterfeit bills/checks detected by the recognition module using the second 3-way switching gate.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Hereinafter, embodiments of the present invention will be described in detail with reference to the accompanying drawings so that they can be readily implemented by those skilled in the art.

Figure 1:
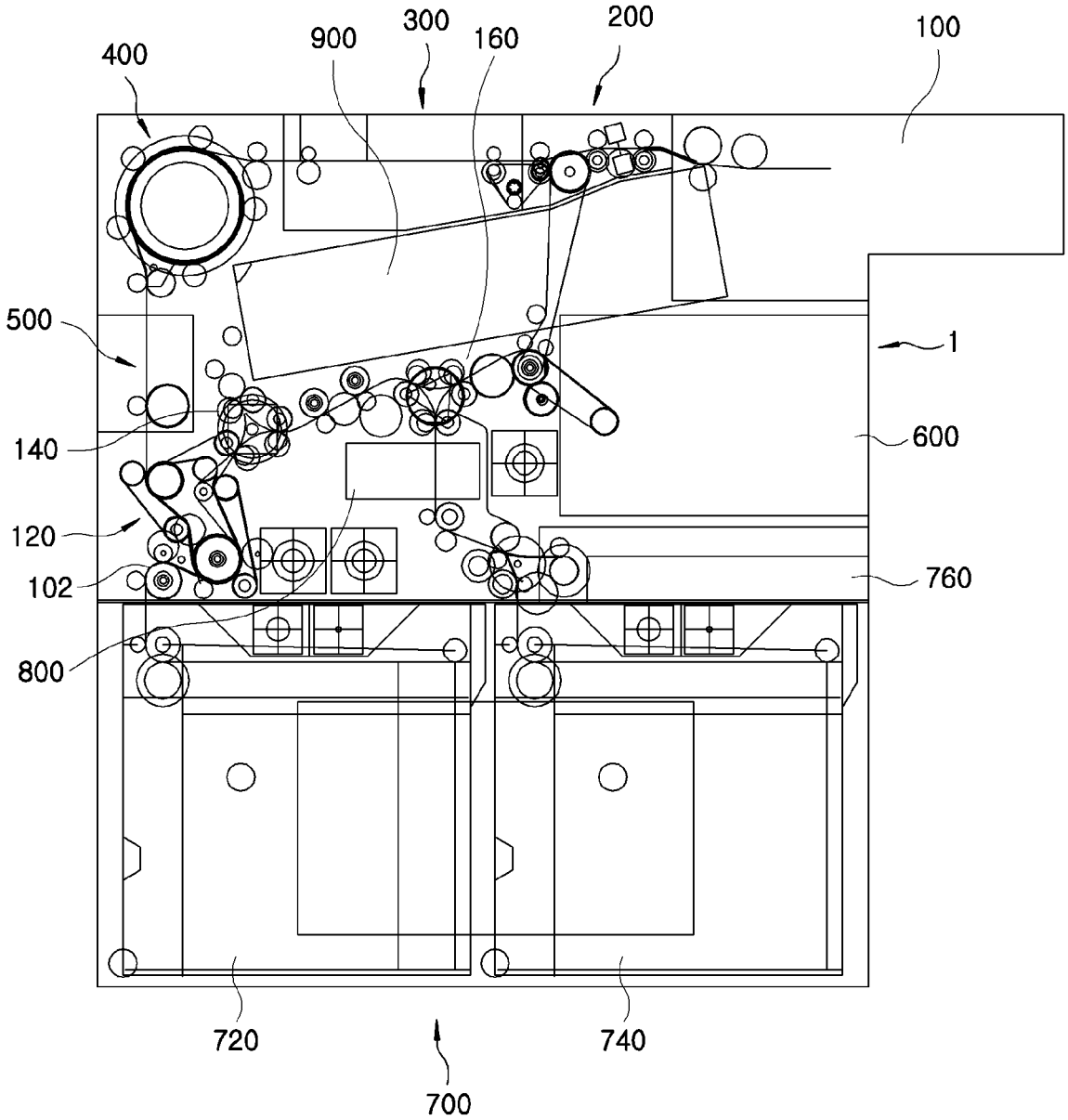
FIG. 1 is a schematic sectional view illustrating a bundle bill/check acceptor in accordance with an embodiment of the present invention.

FIG. 1 is a schematic sectional view illustrating a bundle bill/check acceptor in accordance with the embodiment of the present invention.

As shown in FIG. 1, the bundle bill/check acceptor of the present invention includes a bundle receiving module 100 which is provided on a front and upper portion of a rectangular parallelepiped acceptor body 1. The bundle bill/check acceptor further includes a transfer module 200, a bill checker module 300 and an alignment module 400 which are disposed behind the bundle receiving module 100 and are sequentially arranged in the acceptor body 1. The acceptor further includes a recognition module 500 which is disposed right below the alignment module 400, an escrow module 600 which is level with the recognition module 500 and is disposed on a front surface of the main acceptor body 1, and a print module 800 which is disposed between the recognition module 500 and the escrow module 600. The acceptor further includes a reject module 900 which is disposed in a central portion of the acceptor body 1, and a cassette unit 700 which is disposed in a lower portion of the acceptor body 1 and separately receives bills and checks. The above-mentioned modules are compactly configured in the acceptor body 1.

Although it is not shown in detail in the drawings, the bundle receiving module 100 is disposed on an upper portion of the front surface of the acceptor body 1, as viewed in the side of the acceptor. The bundle receiving module 100 may include an inlet shutter which is opened by driving a pulse motor, and an introduction unit which draws and transfers a plurality of individual bills and checks, e.g., a bundle of a maximum of fifty combined bills and checks, into the bundle bill/check acceptor at low speed by driving a transfer motor that clamps and transfers them. The bundle receiving module 100 also includes a separation unit which separates and transfers the bundle of bills and checks drawn in the introduction unit one after another, and a discharge unit.

In operation, the bills/checks drawn in a bundle from the introduction unit are transferred to the separation unit, a bill press of the separation unit moves upwards and pressurizes the transferred bundle of bills/checks, and then a separation member rotates and separates the bundle of bills/checks one after another using frictional force. Each bill/check that has been separated from the bundle is transferred to the transfer module 200 that is disposed behind the bundle receiving module 100. Hereinafter, for the sake of simple explanation, the bill/check will be collectively referred to as a paper medium.

The transfer module 200 finally monitors, using an ultrasonic sensor and a hall sensor, whether or not each paper medium that has been separated from the bundle by the bundle receiving module 100 is of two or more leaves overlap one above another, and then transfers the separated paper medium. The bill checker module 300 discriminates the authenticity of the separated paper medium that is being transferred after monitoring of the two or more overlap leaves and checks an image of the paper medium to determine whether the paper medium is abnormal or not. At this time, the size of the paper medium, and particularly, if it is a check, information about an introduced position of an endorsement surface of the check are verified.

The paper medium that has passed through the bill checker module 300 is introduced into the drum type alignment module 400 on a leaf-by-leaf basis. The paper medium is aligned based on right edge thereof in the alignment module 400.

Figure 2:
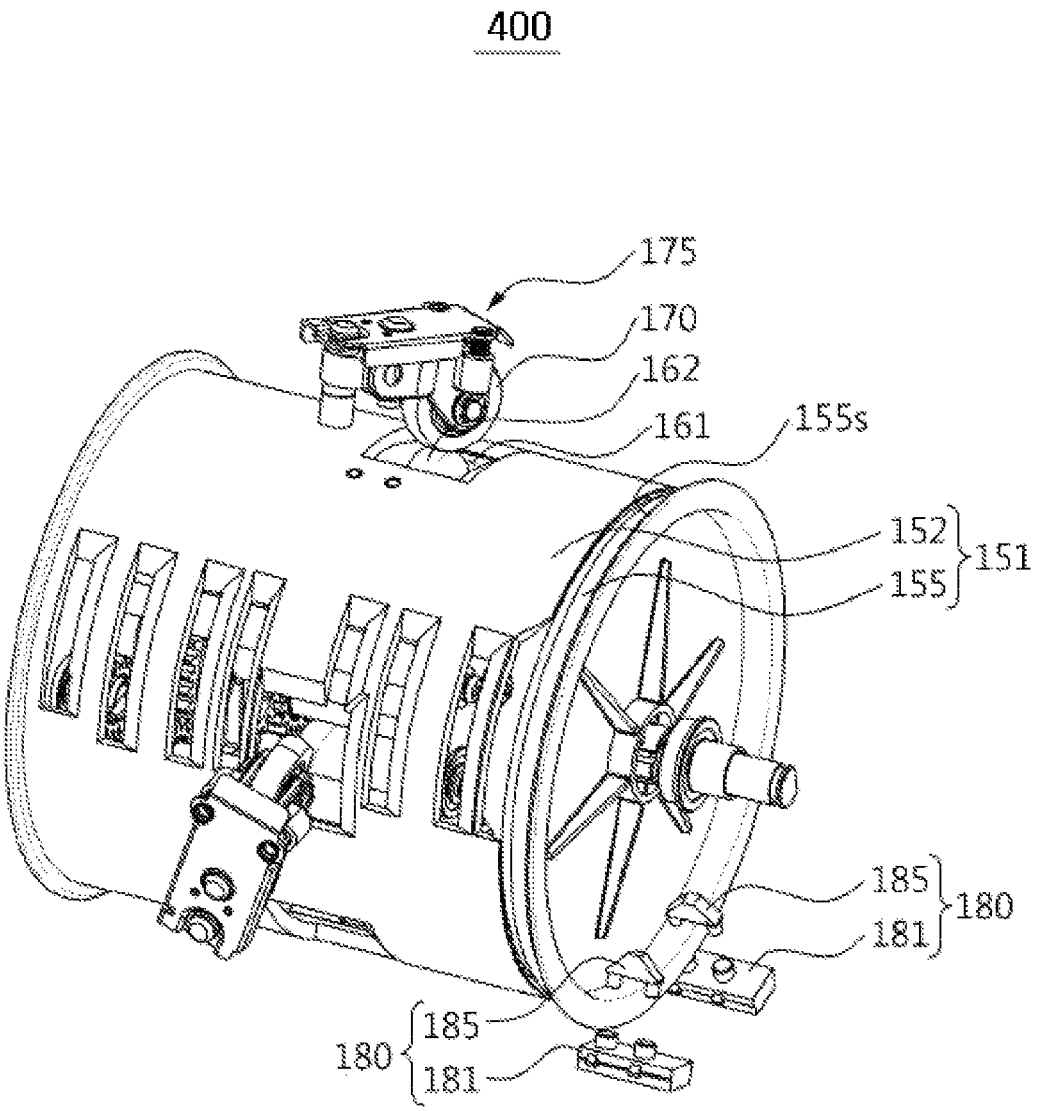
FIG. 2 is a partially exploded perspective view illustrating an alignment module shown in FIG. 1.

FIG. 2 is a partially exploded perspective view illustrating the alignment module in the bundle bill/check acceptor.

The alignment module 400 includes an alignment body 151, a plurality of main transfer rollers 162, a plurality of slant rollers 170, and slant angle adjustment units 175. The alignment body 151 has a reference alignment surface 155*s* which defines a transfer path, along which the paper medium that is a bill or check passes, and becomes an alignment reference so that the paper medium is aligned with the reference alignment surface 155*s* while passing along the transfer path. The main transfer rollers 162 are provided inside the alignment body 151 and transfer the paper medium forwards along the transfer path. The slant rollers 170 are provided outside the alignment body 151 at positions corresponding to the respective main transfer rollers 162. Each slant roller 170 may be oriented such that it is slanted with respect to the direction in which the paper medium is being transferred. The slant angle adjustment units 175 adjust the slant angles of the corresponding slant rollers 170, respectively.

The alignment module 400 further includes a pair of alignment sensors 180 that are provided on the alignment body 151. Each of the alignment sensors 180 includes a light emitting device 181 and a light receiving device 185 that monitor the position of the paper medium and sense whether the paper medium is aligned with the reference alignment surface 155*s*.

The paper medium of the bill or check has passed through the alignment module 400 and then is rotated 90°, changing the orientation thereof.

The alignment body 151 has the shape of a drum in which the main transfer rollers 162 are installed at predetermined intervals. The alignment body 151 includes a drum-shaped fixed body 152 around which the paper medium that is passing moves in circle, and rotatable bodies 155 which are provided on both ends of the first body 152. The diameter of the rotatable bodies 155 is larger than that of the fixed body 152. The side surface of the respective rotatable bodies 155 that faces the fixed body 152 becomes the reference alignment surface 155*s* for the paper medium.

A plurality of through holes 161 are formed in a circumferential outer surface of the fixed body 152. A portion of each main transfer roller 162 protrudes outside the corresponding through hole 161 so that, when the paper medium is supplied onto the circumferential outer surface of the fixed body 152, the paper medium can be transferred in one direction by rotating the main transfer rollers 162.

The rotatable bodies 155 is provided on both ends of the fixed body 152, thus defining the reference alignment surface 155*s*. The paper medium that is being transferred around the fixed body 152 is aligned between the reference alignment surfaces 155*s*. Therefore, the alignment body 151 can transfer the aligned paper medium to a subsequent operation.

Preferably, after the paper medium has been aligned between the reference alignment surfaces 155*s* of the rotatable bodies 155, the rotatable bodies 155 are configured to rotate with respect to the fixed body 152 to prevent the paper medium from wrinkling or tearing when it is transferred by the rotation of the main transfer rollers 162. Specifically, the rotatable bodies 155 are controlled to rotate in a rotating speed corresponding to the movement of the paper medium on the fixed body 152 so that the paper medium is prevented from being wrinkled or torn.

The slant rollers 170 push the paper medium onto the reference alignment surfaces 155*s* of the rotatable bodies 155 so that the paper medium can be put in close contact with the reference alignment surfaces 155*s* while it is being moved by the main transfer rollers 162. In other words, the slant rollers 170 serve to effectively align the paper medium between the reference alignment surfaces 155*s*.

Each slant roller 170 makes partial contact with the outer surface of the corresponding main transfer roller 162, so that when the main transfer roller 162 rotates, the slant roller 170 rotates in a direction opposite to the direction in which the main transfer roller 162 rotates. Therefore, the rotational force of the slant roller causes the paper medium to push towards the reference alignment surfaces 155*s* of the rotatable bodies 155.

When the paper medium is transferred by the operation of the main transfer rollers 162, if the slant rollers 170 continuously push the paper medium in a direction that makes an angle with the direction in which the paper medium is being transferred, in other words, if the slant rollers 170 push the paper medium towards the reference alignment surfaces 155*s* even after the paper medium has been aligned with the reference alignment surfaces 155*s*, a crease may form in the paper medium because of interference from the reference alignment surfaces 155*s*. To avoid this problem, the slant angle adjustment units 175 may adjust the angles of the slant rollers 170 based on information obtained from the alignment sensors 180, as described above, which senses whether the paper medium is aligned with the reference alignment surface 155*s*.

Referring again FIG. 1, the recognition module 500 includes an MICR (Magnetic Ink Character Reader). The recognition module 500 is placed almost upright in a rear end of the main acceptor body 1. The MICR reads the serial number and the like printed on each check. After reading, the check is transferred to the escrow module 600.

The shape of the escrow module 600 is that of a tape reel. The escrow module 600 is level with the recognition module 500 and is disposed in the front end of the main acceptor body 1. Furthermore, a plurality of paper media, e.g. up to fifty, of a bundle of paper media are escrowed by the escrow module 600 in the same manner as that of a cassette tape.

After the respective paper media have been escrowed, images of the paper media that have been scanned by the recognition module 500 having a CIS (Contact Image Sensor) unit are displayed to a user (a customer). The user monitors the state of the paper media and issues a request that the paper media introduced into the acceptor body 1 be processed.

For instance, when the user requests the bundle bill/check acceptor to deposit all of the displayed paper media, e.g., checks all at once or to selectively deposit some of the displayed checks, the escrowed checks are separated and selected one after another, and the selected check is then transferred to the print module 800 located between the recognition module 500 and the escrow module 600.

The print module 800 includes an ink unit which has an endorsement function. The bundle bill/check acceptor of the present invention conducts a turning upside down function, which will be explained later herein, depending on the orientation of a check input into the bundle receiving module 100, thus allowing a character string to be printed on the endorsement surface of the check. The endorsed check is transferred to the cassette unit 700.

The reject module 900 is disposed in the central portion of the main acceptor body 1. Among a bundle of bills/checks introduced into the bundle bill/check acceptor, a damaged or unrecognizable bill/check, which needs to be rejected, and a bill or check, which was escrowed in the escrow module 600, may be transferred in a bundle by the reject module 900 into the returning unit of the receiving module 100 accordance with a deposit cancel request from the user.

The bundle bill/check accepter further includes a U-shaped transfer path 120 disposed below the recognition module 500, and first and second 3-way switching gates 140 and 160 that are sequentially provided on the transfer path between the recognition module 500 and the escrow module 600.

The first 3-way switching gate 140 is switched such that a rejected paper medium recognized by the recognition module 500 is transferred to the reject module 900, or a paper medium escrowed in the escrow module 600 is transferred to the reject module 900 in response to a deposit cancel request from the user, or a paper medium escrowed in the escrow module 600 is transferred to the cassette unit 700 in response to a deposit approval request from the user.

The second 3-way switching gate 160 is switched such that each normal paper medium escrowed in the escrow module 600 is transferred to the cassette unit 700 via the first 3-way switching gate 140 and the U-shaped transfer path 120, or if the endorsement surface of each check escrowed in the escrow module 600 is oriented in the correct direction, the escrowed check is transferred to the print module 800, or otherwise, the escrowed check is transferred to the transfer path between the first and second 3-way switching gates 140 and 160 before being transferred to the print module 800. It can be determined whether the endorsement surface of each escrowed check is oriented in the correct direction by using the introduced position of the endorsement surface of the check transferred from the bill checker module 300. Furthermore, the second 3-way switching gate 160 is used to transfer a paper medium that has been determined to be counterfeit into a retraction box 760.

The cassette unit 700 includes a bill storage cassette 720 which stores normal bills, and a check storage cassette 740 which stores normal checks. In this embodiment, the structure of the bill storage cassette 720 is the same as that of the check storage cassette 740. In the bundle bill/check accepter as shown in FIG. 1, the bill storage cassette 720 is disposed at the left position, and the check storage cassette 740 is disposed on the right side of the check storage cassette 740. The bill storage cassette 720 and the check storage cassette 740 are adjacent to and are lined up with each other, and are removably installed in the acceptor body 1. Alternatively, the bill storage cassette 720 and the check storage cassette 740 may switch positions.

The cassette unit 700 further includes a retraction box 760. The refraction box 760 separately stores a retraction paper medium of the rejected paper medium discharged to the bundle receiving module 100 by the reject module 900, and a counterfeit paper medium detected by the recognition module 500. In this embodiment, the retraction box 760 is disposed between the escrow module 600 and a bill or check storage cassette 720 or 740.

The bundle bill/check acceptor of the embodiment complies with the regulations of Article 6, of the European Central Bank that requires that counterfeit bill/checks be stored in a separate storage location.

The operation of the bundle bill/check acceptor of the present invention having the above-mentioned construction will be described with reference to FIGS. 3 through 6.

Figure 3:
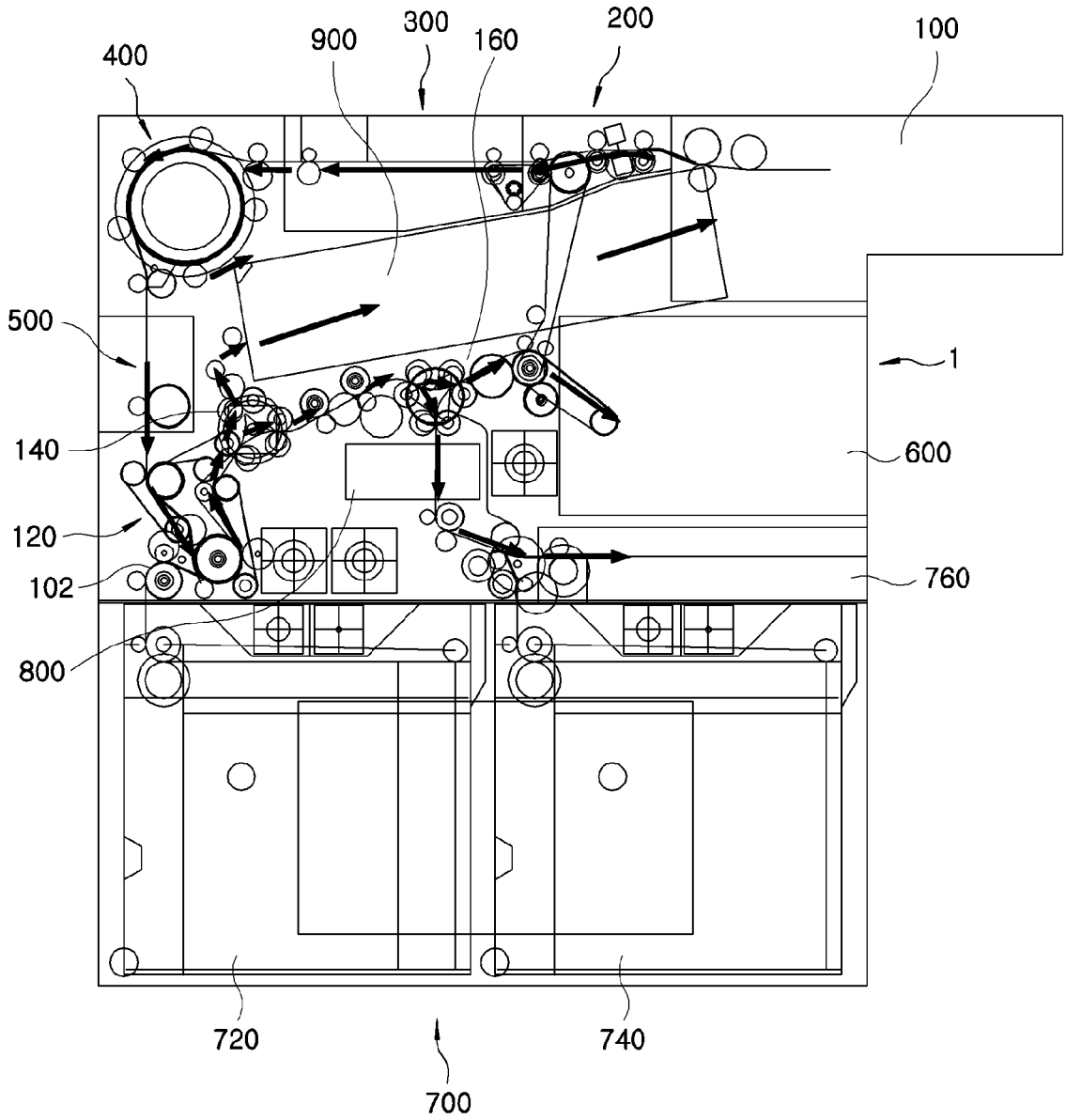
FIG. 3 is a schematic sectional view showing a transfer path of a bill/check in deposit calculation mode of the bundle bill/check acceptor.

FIG. 3 illustrates a transfer path of a paper medium when calculating a deposit.

In deposit calculation mode, a bundle of combined bills and checks is introduced into the bundle receiving module 100. The introduced bundle sequentially passes the transfer module 200, the bill checker module 300, the alignment module 400, the recognition module 500, the U-shaped transfer path 120 and the first and second 3-way switching gates 140 and 160 and then is escrowed in the escrow module 600.

A damaged or unrecognizable bill that is detected by the bill checker module 300 and needs to be rejected is discharged from the U-shaped transfer path 120 to the bundle receiving module 100 via the reject module 900.

In the case of a counterfeit bill/check that is detected by the bill checker module 300, the transfer path thereof is switched towards the reject module 900 by the second 3-way switching gate 160 so that the counterfeit bill/check can be separately received in the retraction box 760.

In the bundle bill/check acceptor of the embodiment of the present invention, when the escrow module 600 conducts the escrow function, the rejected bills/checks, counterfeit bills/checks and normal bills/checks are separated by the 3-way switching gates and separately stacked one on top of another. In such an escrow state, after receiving confirmation from the user, the bills/checks are bulk-processed depending on the reception of deposit approval or deposit cancel.

Figure 4:
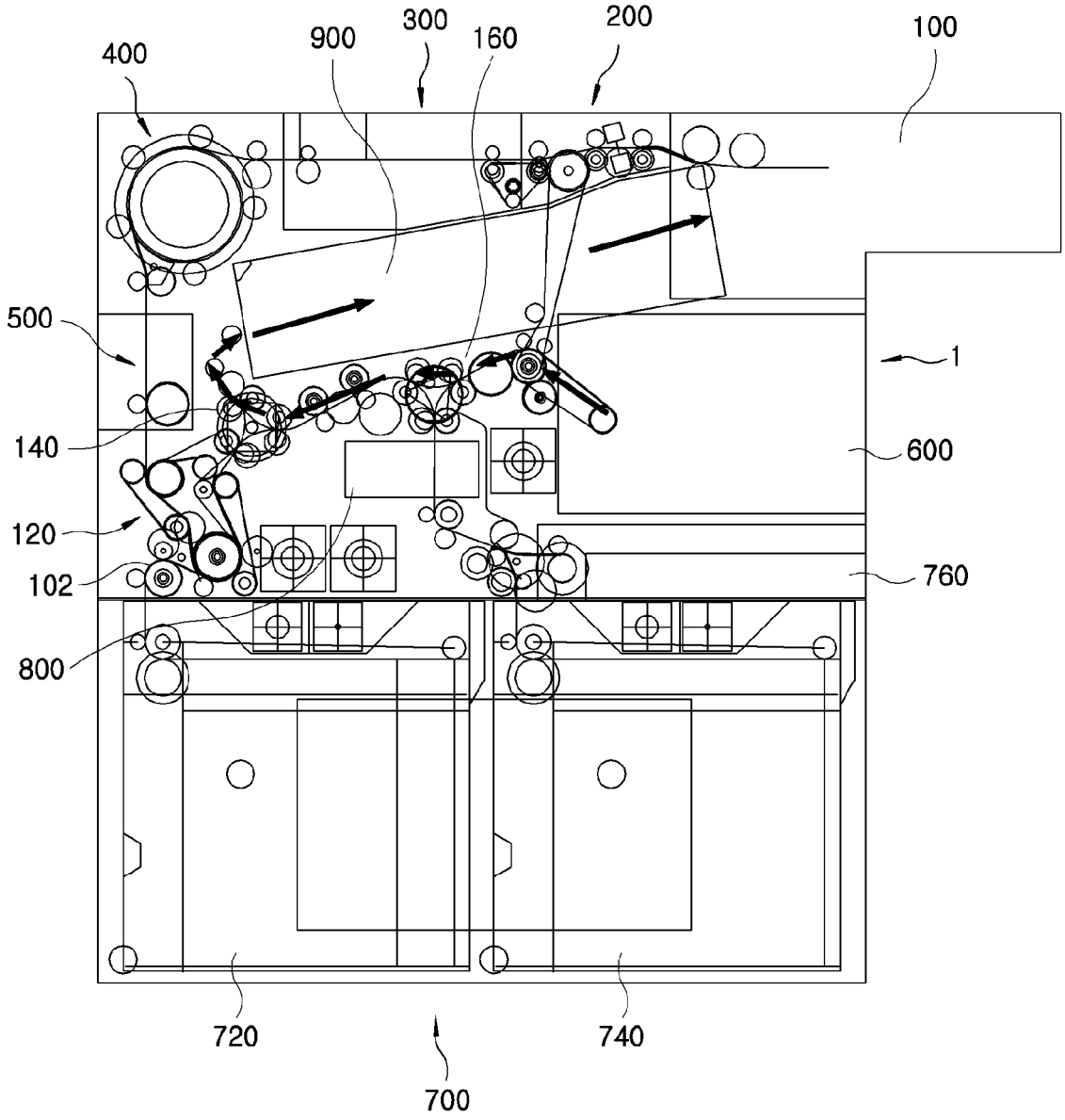
FIG. 4 is a schematic sectional view showing a transfer path followed by a bill/check in a deposit approval mode of the bundle bill/check acceptor.

If the user requests the bundle bills/check acceptor to cancel the deposit given the escrow state illustrated in FIG. 3, the bills and/or checks escrowed in the escrow module 600 are discharged to the bundle receiving module 100 via the second 3-way switching gate 160, the first 3-way switching gate 140 and the reject module 900, as shown in FIG. 4 that illustrates a transfer path followed by a paper medium when the deposit is canceled.

Figure 5:
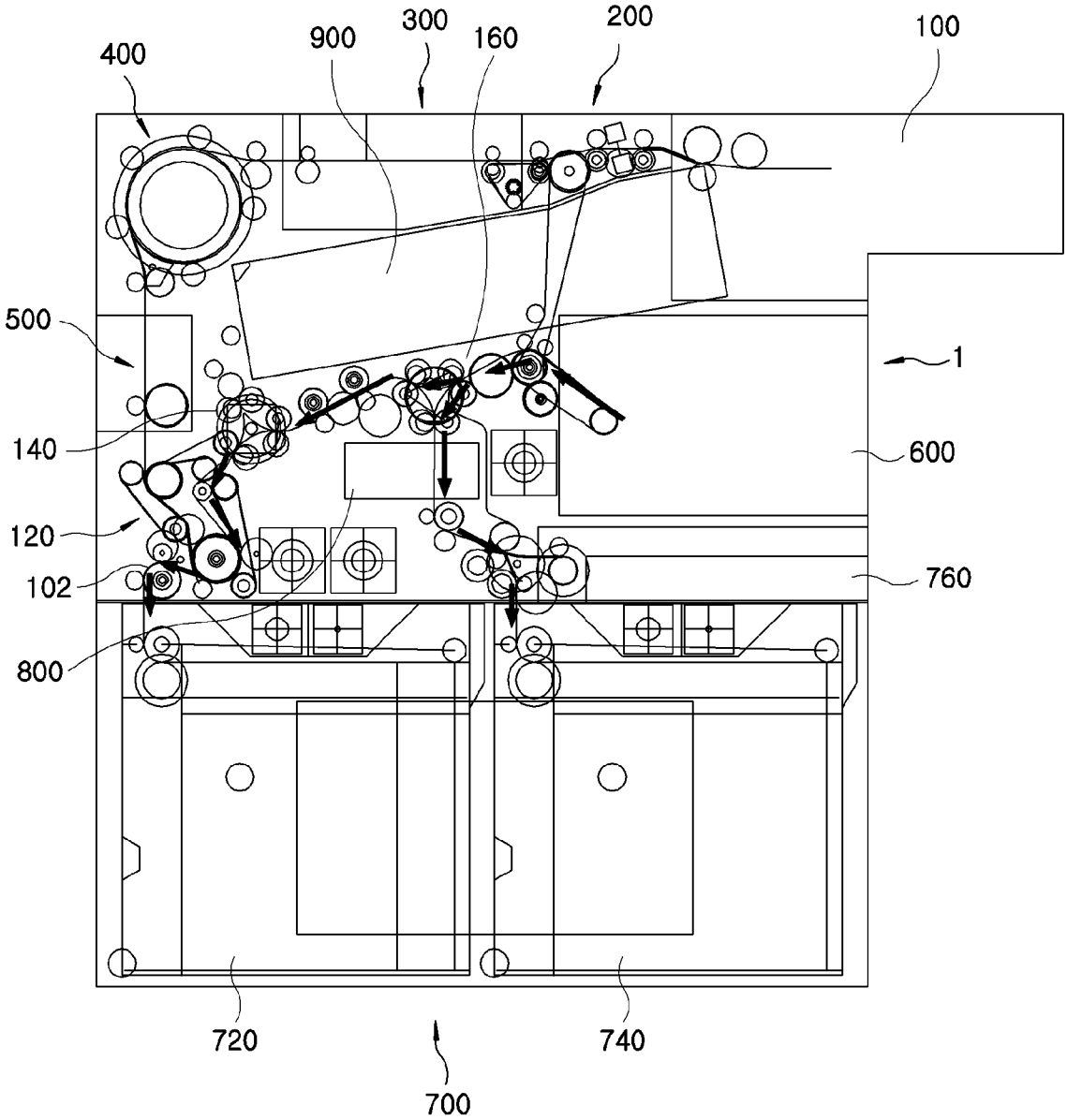
FIG. 5 is a schematic sectional view showing a transfer path that a bill/check follows in a deposit cancel mode of the bundle bill/check acceptor.

On the other hand, in the escrow state of FIG. 3, if the user instructs the bundle bill/check acceptor to make the deposit, the normal bills are received into the bill storage cassette 720 via the second and first 3-way switching gates 160 and 140, the U-shaped transfer path 120, and a switching gate 102 disposed between the U-shaped transfer path 120 and the bill storage cassette 720, as shown in FIG. 5 which illustrates the transfer path that a paper medium follows when the deposit is allowed to be made.

In the case of checks, if an endorsement surface of a check was oriented in the correct direction, the check is directly transferred from the bill checker module 300 to the print module 800 by the second 3-way switching gate 160, and is endorsed, and then is received into the check storage cassette 740.

Otherwise, if an endorsement surface of a check was not oriented in the correct direction, the check is transferred from the bill checker module 300 to the first 3-way switching gate 140 by the second 3-way switching gate 160, and is turned upside down such that the orientations of the sides of the check are changed with each other, and then sent to the print module 800. Subsequently, the check is endorsed in the print module 800 and then received into the check storage cassette 740.

Figure 6:
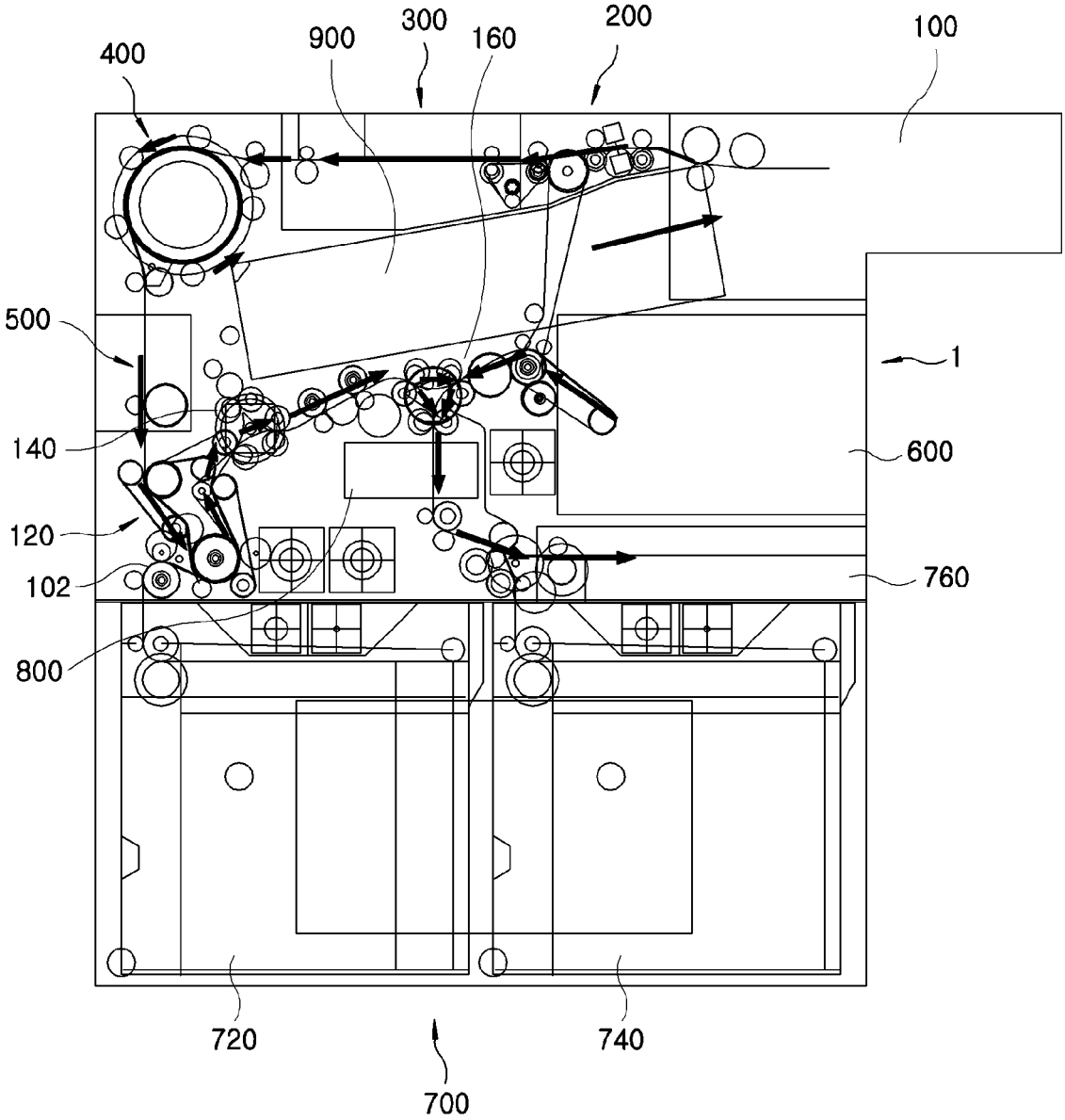
FIG. 6 is a schematic sectional view showing a transfer path followed by a bill/check in a retraction mode of the bundle bill/check acceptor.

FIG. 6 illustrates the transfer path followed by a paper medium when being retracted.

The retraction mode is classified into the case where an unreceived bill/check is in the bundle receiving module 100 and the case where an unreceived bill/check is in the escrow module 600.

In the case where the unreceived bill/check is in the bundle receiving module 100, the unreceived bill/check is retracted into the refraction box 760 via the transfer module 200, the bill checker module 300, the alignment module 400, the recognition module 500, the U-shaped transfer path 120, the first and second 3-way switching gates 140 and 160 and the print module 800.

In the case where the unreceived bill/check is in the escrow module 600, the unreceived bill/check is retracted into the retraction box 760 via the print module 800 by the second 3-way switching gate 160.

As described above, in a bundle bill/check acceptor in accordance with the embodiment, a bill acceptor and a bundle check acceptor are combined into a single apparatus. Components are efficiently arranged so that even if a bundle of bills and checks of different widths and lengths are introduced into the acceptor, they can be accepted. Particularly, in the case of checks, the bundle bill/check acceptor can accept them regardless of the orientations in which the checks are introduced. Therefore, the embodiment may increase the convenience of use and achieve a compact design.

While the invention has been shown and described with respect to the preferred embodiment, the invention is not limited thereto. It will be understood by those skilled in the art that various changes and modifications may be made without departing from the scope of the invention as defined in the following claims.

What is claimed is:

1. A bundle bill/check acceptor, comprising:

a bundle receiving module configured to receive a bundle of bills/checks that are introduced into the bundle bill/check acceptor;

a transfer module disposed behind the bundle receiving module, wherein the transfer module is configured to separate the bundle of bills/checks received from the bundle receiving module into individual bill/check on a leaf-by-leaf basis, and then transferring the individual bill/check;

a bill checker module configured to discriminate authenticity of the individual bill or check that is being transferred and to monitor an image of the individual bill or check;

an alignment module configured to align the individual bill/check transferred from the bill checker module;

a recognition module disposed right below the alignment module, the recognition module is configured to read data on each of the individual checks transferred from the alignment module;

an escrow module disposed on a front end of the acceptor body, the escrow module is configured to escrow the bills/checks transferred from the recognition module;

a print module disposed between the recognition module and the escrow module, the print module is configured to endorse each of the checks escrowed by the escrow module;

a reject module disposed in a central portion of the acceptor body, the reject module is configured to discharge, to the bundle receiving module, a rejected bill/check that cannot be discriminated by the bill checker module or a bill/check escrowed by the escrow module upon a request to cancel the deposit thereof; and a cassette unit provided in a lower portion of the acceptor body, wherein the cassette unit is configured to separately receive the bills escrowed by the escrow module, the check endorsed by the print module, a retraction bill/check of the rejected bill/check discharged to the bundle receiving module by the reject module, and a bill/check that is determined as being a counterfeit bill/check by the recognition module.

2. The bundle bill/check acceptor of claim 1, wherein the alignment module comprises:

a drum-shaped alignment body defining a transfer path along which each of the bills/checks from the transfer module is passing in a circle;

a main transfer roller provided in the drum-shaped body;

a slant roller provided outside the drum-shaped body, whereby the bill/check is aligned with one side of the transfer path; and an alignment sensor provided on the transfer path configured to sense whether the bill/check is aligned with a reference alignment surface, wherein the aligned bill/check that has been sensed by the alignment sensor is transferred to the recognition module.

3. The bundle bill/check acceptor of claim 2, wherein the drum-shaped alignment body comprises:

a fixed body around which the paper medium that is passing moves in a circle; and rotatable bodies which are provided on both ends of the fixed body, wherein the diameter of the rotatable bodies is larger than that of the fixed body, and the side surface of one of the rotatable bodies that faces the fixed body becomes the reference alignment surface for the paper medium.

4. The bundle bill/check acceptor of claim 3, wherein each of the rotatable bodies is configured to rotate with respect to the fixed body.

5. The bundle bill/check acceptor of claim 3, wherein the alignment module further comprises a slant angle adjustment unit configured to adjust the angles of the slant rollers based on information obtained from the alignment sensor.

6. The bundle bill/check acceptor of claim 1, wherein the recognition module comprises an MICR (Magnetic Ink Character Reader) reading information on each of the checks transferred thereto before transferring the check to the escrow module.

7. The bundle bill/check acceptor of claim 1, wherein, in response to a request for entire or selective deposit approval of the bills/checks escrowed by the escrow module, the escrow module is configured to separate the escrowed bills/checks one after another and then transfers the separated bill/check to the cassette unit, and wherein the separated check is transferred to the print module before being transferred to the cassette unit.

8. The bundle bill/check acceptor of claim 1, wherein, in response to a request for entire or selective deposit cancel of the bills/checks escrowed by the escrow module, the escrow module is configured to separate the escrowed bills/checks one after another and then transfers the separated bill/check one after another to the bundle receiving module via the reject module.

9. The bundle bill/check acceptor of claim 1, further comprising:

a U-shaped transfer path disposed below the recognition module; and first and second 3-way switching gates sequentially provided on a transfer path between the recognition module and the escrow module.

10. The bundle bill/check acceptor of claim 9, wherein the first 3-way switching gate is selectively switched:

such that a rejected bill/check recognized by the bill checker or the recognition module is transferred to the reject module, such that the bill/check escrowed by the escrow module is transferred to the reject module in response to the request for deposit cancel, or such that the bills/checks escrowed by the escrow module is transferred to the cassette unit in response to the request for deposit approval.

11. The bundle bill/check acceptor of claim 9, wherein the second 3-way switching gate is selectively switched:

such that normal bills/checks escrowed by the escrow module are transferred to the cassette unit via the first 3-way switching gate and the U-shaped transfer path, such that the escrowed check is transferred to the print module if an endorsement surface of each of the checks escrowed by the escrow module is oriented in a correct direction, or such that the escrowed check is transferred to the print module after being transferred to the transfer path between the first and second 3-way switching gates if an endorsement surface of each of the checks is not oriented in the correct direction.

12. The bundle bill/check acceptor of claim 11, wherein the cassette unit further comprises:

a refraction box separately storing retraction bills/checks of the rejected bills/checks discharged to the bundle receiving module by the reject module, and counterfeit bills/checks detected by the recognition module using the second 3-way switching gate.

13. The bundle bill/check acceptor of claim 1, wherein the cassette unit comprises:

a bill storage cassette for receiving normal bills; and a check storage cassette for receiving normal checks, wherein the bill storage cassette and the check storage cassette have a same structure and are disposed level with and adjacent to each other.

* * * * *